US010535215B2

(12) United States Patent
Obata et al.

(10) Patent No.: US 10,535,215 B2
(45) Date of Patent: Jan. 14, 2020

(54) SWITCH UNIT AND VENDING MACHINE

(71) Applicant: MINEBEA MITSUMI Inc., Nagano (JP)

(72) Inventors: Yasutoshi Obata, Kanagawa (JP); Yu Imai, Kanagawa (JP)

(73) Assignee: MINEBEA MITSUMI INC., Nagano (JP)

( * ) Notice: Subject to any disclaimer, the term of this patent is extended or adjusted under 35 U.S.C. 154(b) by 0 days.

(21) Appl. No.: 16/044,664

(22) Filed: Jul. 25, 2018

(65) Prior Publication Data

US 2018/0330564 A1 Nov. 15, 2018

Related U.S. Application Data

(63) Continuation-in-part of application No. PCT/JP2017/002955, filed on Jan. 27, 2017.

(30) Foreign Application Priority Data

Jan. 27, 2016 (JP) ..... 2016-013612

(51) Int. Cl.
*G07F 9/00* (2006.01)
*G07F 9/02* (2006.01)

(52) U.S. Cl.
CPC ..... *G07F 9/02* (2013.01); *G07F 9/006* (2013.01)

(58) Field of Classification Search
CPC ..... G07F 9/006
See application file for complete search history.

(56) References Cited

U.S. PATENT DOCUMENTS 3,752,287 A * 8/1973 Cullum ..... G07F 5/10 194/215
4,834,231 A * 5/1989 Awane ..... G07F 5/22 194/217
5,275,565 A * 1/1994 Moncrief ..... A63F 13/08 434/29

(Continued)

FOREIGN PATENT DOCUMENTS

JP 03-154994 A 7/1991
JP 2001-291151 A 10/2001

(Continued)

OTHER PUBLICATIONS

English translation of Written Opinion for corresponding International Application No. PCT/JP2017/002955 dated Apr. 18, 2017.

(Continued)

*Primary Examiner* — Timothy R Waggoner
(74) *Attorney, Agent, or Firm* — Pearne & Gordon LLP

(57) ABSTRACT

Provided is a switch unit that drastically reduces the effort required to assemble a vending machine. The switch unit includes: a commodity selection part; an illumination part; a price display part; and a control part, wherein the switch unit is communicatively connected to at least one slave switch unit, and the control part includes: a position determination part configured to determine a relative position of the slave switch unit to the switch unit; and a code impartment part configured to impart a code to each of the keys of each of the switch unit and the slave switch unit on the basis of the determined relative position.

8 Claims, 10 Drawing Sheets

(56) References Cited

U.S. PATENT DOCUMENTS

2004/0228337 A1* 11/2004 Naoi ..... H04L 49/101
370/360

FOREIGN PATENT DOCUMENTS

| | | | |
|---|---|---|---|
| JP | 2002-163713 | A | 6/2002 |
| JP | 2004-234363 | A | 8/2004 |
| JP | 2011-028439 | A | 2/2011 |
| JP | 2013-137602 | A | 7/2013 |
| JP | 2015-036950 | A | 2/2015 |

OTHER PUBLICATIONS

English translation of International Preliminary Report on Patentability for corresponding International Application No. PCT/JP2017/002955 dated Jul. 31, 2018.
International Search Report for corresponding International Application No. PCT/JP2017/002955 dated Apr. 18, 2017.
Written Opinion for corresponding International Application No. PCT/JP2017/002955 dated Apr. 18, 2017.
Decision to Grant a Patent dated Jul. 23, 2019 for corresponding Japanese Application No. 2016-013612 and English trnaslation.

* cited by examiner

| | SWITCH UNIT POSITION | | |
|---|---|---|---|
| | LEFT | CENTER | RIGHT |
| ADDRESS (SA0, SA1) | SELF | (H, L) | (L, L) |
| | (L, H) | SELF | (H, L) |
| | (L, L) | (L, H) | SELF |

FIG.8

| DETERMINATION CIRCUIT (L: 4 KEYS, H: 6 KEYS) | | | TOTAL NUMBER OF KEYS | | | | | |
|---|---|---|---|---|---|---|---|---|
| LEFT | CENTER | RIGHT | 8 | 10 | 12 | 14 | 16 | 18 |
| L | | L | ○ | | | | | |
| L | | H | | ○ | | | | |
| H | | L | | ○ | | | | |
| H | | H | | | ○ | | | |
| L | L | H | | | | ○ | | |
| L | H | L | | | | ○ | | |
| H | L | L | | | | ○ | | |
| H | H | L | | | | | ○ | |
| L | H | H | | | | | ○ | |
| H | L | H | | | | | ○ | |
| H | H | H | | | | | | ○ |

FIG.9

| Service | Command | Data | Check sum | NOTES |
|---|---|---|---|---|
| General | Reset | * * * * * | TOTAL OF VALUES OF 1 TO 8 BYTES EXCEPT Check sum (TRUNCATE BYTES OTHER THAN LEAST SIGNIFICANT BYTE) | RESET OF DATA IN MAIN MICROCOMPUTER |
| | Select | * * * * * | | NOTIFICATION OF SELECTED SWITCH (COLUMN) NUMBER |
| | Price | * * * * * | | SETTING OF THE SAME PRICE OF ALL SWITCHES (COLUMNS) |
| | Display | * * * * * | | SETTING OF THE SAME DISPLAY OF ALL SWITCHES (COLUMNS) |
| | Illmination | * * * * * | | ILLUMINATION DISPLAY (SETTING NUMBER) |
| Light | Dimmer | * * * * * | | CONTROL OF LED ILLUMINATION DIMMING LEVEL (kHz) |
| Switch | Select | * * * * * | | DETERMINATION RESULT OF DESIGNATED SWITCH NUMBER |
| | Price | * * * * * | | SETTING OF PRICE OF DESIGNATED SWITCH NUMBER |
| | Display | * * * * * | | SETTING OF DISPLAY OF DESIGNATED SWITCH NUMBER |

FIG.10

SWITCH UNIT AND VENDING MACHINE

CROSS REFERENCE TO RELATED APPLICATIONS

The present application is a continuation application of International Application No. PCT/JP2017/002955, filed on Jan. 27, 2017, which claims priority to Japanese Patent Application No. 2016-013612, filed on Jan. 27, 2016. The contents of these applications are incorporated herein by reference in their entirety.

BACKGROUND

Technical Field

The present disclosure relates to a technology of a switch unit used for a vending machine or the like.

Background

When a vending machine is assembled, a plurality of switch units are attached to a vending machine, and thereafter allocation work for allocating a plurality of purchase buttons provided in each of the switch units to a vending machine body, that is, a main controller is performed. This allocation work is performed for each vending machine and for replacement of each commodity, and imposes an appropriate burden on a worker. Additionally, in a conventional vending machine, a key, a commodity illumination light source and a price display light source corresponding to each of the purchase buttons are independently connected to the main controller, and therefore the allocation work needs to be performed for each key, for each commodity illumination light source and for each price display light source, and imposes a great burden on a worker.

Japanese Patent Application Laid-Open No. 2013-137602 discloses, as a switch unit of a vending machine, "a switch unit including a plurality of information display light sources for displaying various information necessary for a user, a sensor for detecting proximity or contact of a finger of the user and a plurality of illumination light sources for illuminating a display article, wherein the plurality of information display light sources and the sensor are disposed on a user side while the plurality of illumination light sources are formed integrally on the other side different from the user side and disposed on a back side of a front panel which displays the display article". According to Japanese Patent Application Laid-Open No. 2013-137602, a key, a commodity illumination light source and a price display light source are integrally formed, and therefore allocation work for each key, for each commodity illumination light source and for each price display light source is not required, and it is possible to reduce a burden imposed on a worker to some extent.

SUMMARY

However, when a vending machine is assembled, a worker randomly attaches a plurality of switch units previously prepared. Therefore, the worker still needs to allocate purchase buttons, and an appropriate burden is required. In Japanese Patent Application Laid-Open No. 2013-137602, neither this situation nor a method for solving this situation is described or suggested.

The present disclosure remarkably reduces the amount of work required to assemble a vending machine.

In accordance with one aspect of the present disclosure, the present disclosure is a switch unit including: a commodity selection part; an illumination part; a price display part; and a control part, wherein the switch unit is communicatively connected to at least one slave switch unit, and the control part includes: a position determination part configured to determine a relative position of the slave switch unit to the switch unit; and a code impartment part configured to impart a code to each of the keys of each of the switch unit and the slave switch unit on the basis of the determined relative position.

According to the present disclosure, it is possible to remarkably reduce the amount of work required to assemble a vending machine.

BRIEF DESCRIPTION OF THE DRAWINGS

FIG. 8 is a table illustrating relationship between positions and addresses of the switch units.

FIG. 9 is a table for determining the number of keys.

FIG. 10 illustrates an example of a communication format used in transmission and reception between the switch units and a vending machine system.

DETAILED DESCRIPTION

An embodiment for carrying out the present disclosure will be described in detail with reference to the accompanying drawings.

Figure 1:
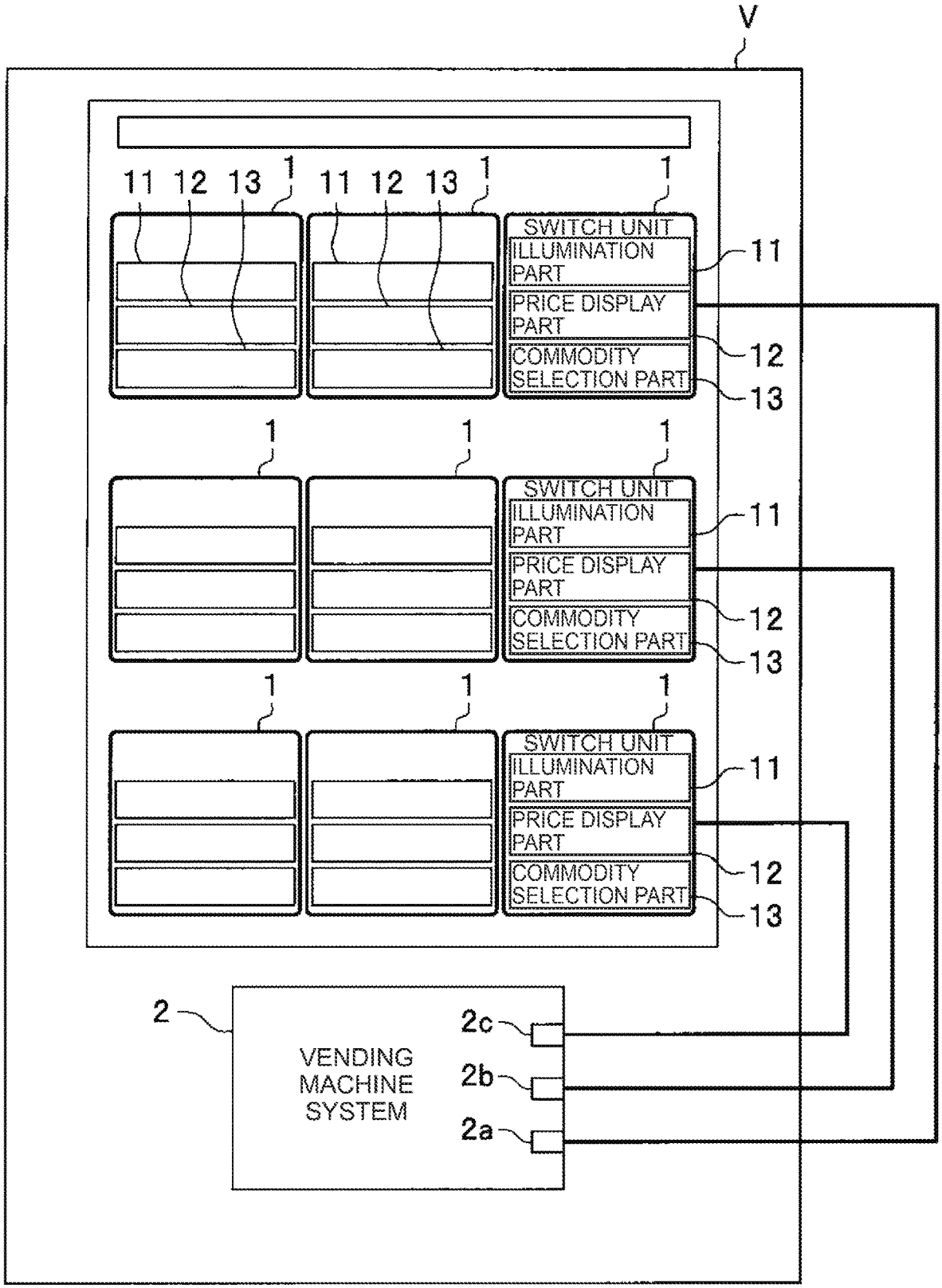
FIG. 1 is a schematic overall view of a vending machine.

As illustrated in FIG. 1, a vending machine V of the present embodiment mainly includes switch units 1 disposed in three rows and three columns and a vending machine system 2. The vending machine system 2 integrally controls processes of respective parts (including the switch units 1) provided in the vending machine V. Each switch unit 1 is a unit for receiving operation for purchasing a commodity handled by the vending machine V by a user.

Each switch unit 1 includes an illumination part 11, a price display part 12 and a commodity selection part 13, and the illumination part 11, the price display part 12 and the commodity selection part 13 are integrally formed.

The illumination part 11 is a light source for illuminating a sample (not illustrated) of a commodity to be an object of purchase operation from a user.

The price display part 12 is a light source for displaying a price of the commodity to be an object of purchase operation from a user, and is, for example, a 7 segment LED (Light Emitting Diode).

The commodity selection part 13 is a purchase button for receiving purchase operation from a user.

The vending machine system 2 includes three ports 2*a*, 2*b* and 2*c*. The port 2*a* is an interface communicatively connecting the vending machine system 2 and all of the three switch units 1 disposed in a top row via a communication line. The port 2*b* is an interface communicatively connecting the vending machine system 2 and all of the three switch units 1 disposed in an intermediate row via a communication line. The port 2*c* is an interface communicatively connecting the vending machine system 2 and all of the three switch units 1 disposed in a bottom row via a communication line.

Figure 2A:
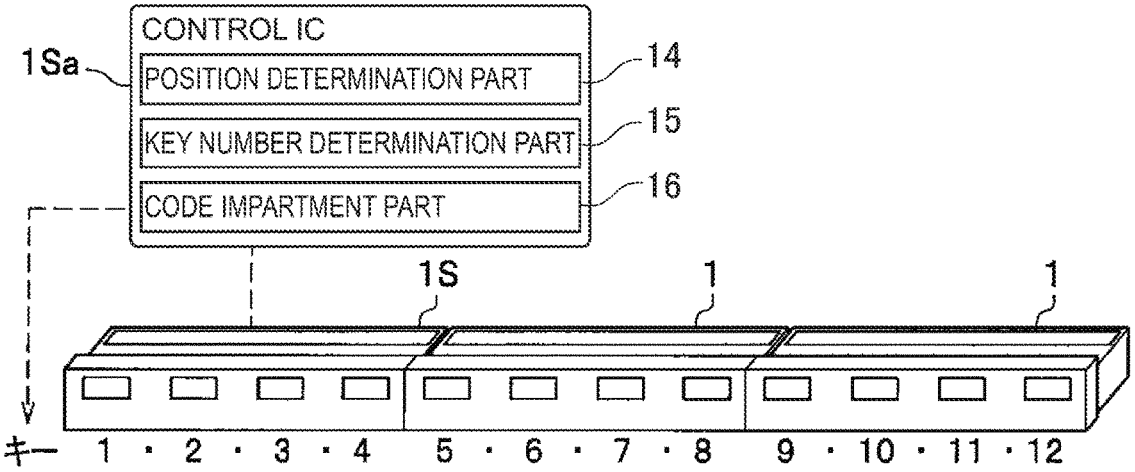
FIGS. 2A, 2B and 2C are each an explanatory diagram of an example of impartment of a key code to each key of three switch units disposed in a single row, and FIGS. 2A, 2B and 2C correspond to a case where the switch unit including a control IC is on the left side, a case where the switch unit including the control IC is in the center, and a case where the switch unit including the control IC is on the right side, respectively.
Figure 2B:
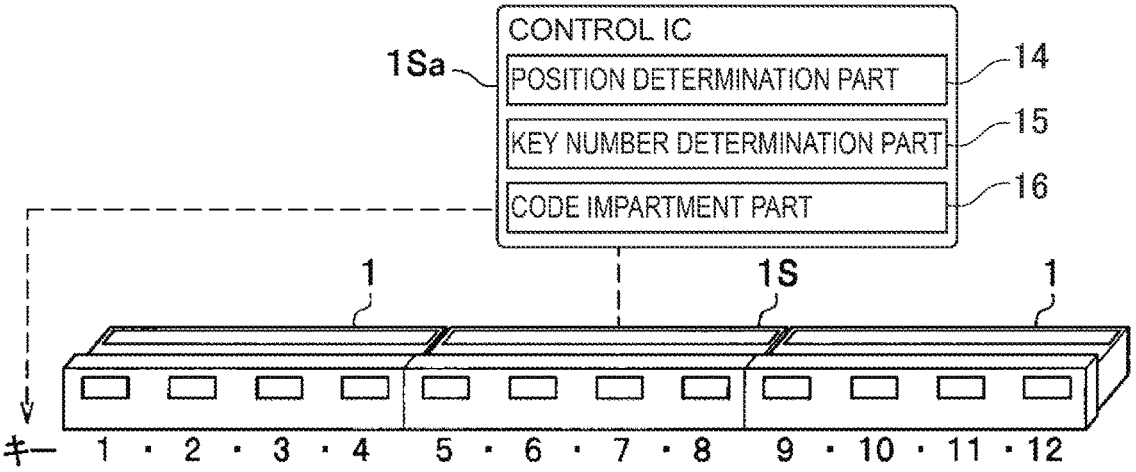
Figure 2C:
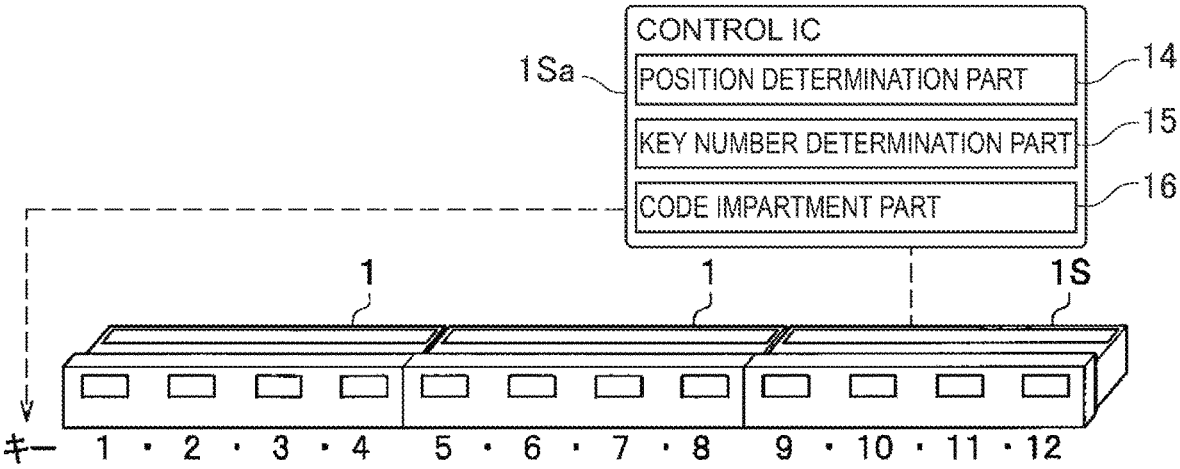

As illustrated in FIGS. 2A to 2C, among the three switch units 1 (unit group) disposed in a single row, the one switch unit 1 is a switch unit 1S including a control IC (Integrated Circuit) (1Sa) (control part) while the other two switch units 1 (slave switch units) do not include any control IC (1Sa). Accordingly, as illustrated in FIGS. 2A to 2C, in the single row the switch unit 1S is disposed on any of the left, the center and the right among the other two switch units 1. Such relative positional relationship among the three switch units 1 disposed in the single row is randomly determined by a worker attaching the switch units 1 to the vending machine V.

The control IC (1Sa) is a part for exchanging information with the vending machine system 2, and controlling not only operation of the switch unit 1S but also operation of the other switch units 1 in the same row. The control IC (1Sa) includes a position determination part 14, a key number determination part 15 and a code impartment part 16.

The position determination part 14 determines respective relative positions of the three switch units 1 disposed in the single row. A method for determining the positions by the position determination part 14 will be described below.

The key number determination part 15 determines the number of keys of each of the three switch units 1 disposed in the single row. Each key is a mark for identifying the sample of the commodity of the vending machine V, and is provided for each commodity selection part 13. For example, four or six keys can be set for each of the switch units 1. According to FIGS. 2A to 2C, the number of keys of each of the three switch units 1 disposed in the single row is four, and the total is 12 keys. A method for determining the number of keys by the key number determination part 15 will be described below.

The code impartment part 16 imparts a key code (code) to each key of each of these three switch units 1, 1S on the basis of the relative positions of the three switch units 1, 1S disposed in the single row in an arbitrary order. The respective positions of the three switch units 1, 1S are determined by the position determination part 14, and therefore the code impartment part 16 can impart the key codes in the order from the left such as 1, 2, . . . , as illustrated in FIGS. 2A to 2C in whatever order the three switch units 1, 1S are disposed. Accordingly, the key codes are imparted to the commodities of the vending machine V, and allocation work of each of the illumination parts 11, the price display parts 12 and the commodity selection parts 13 to the vending machine system 2 is implemented.

«Position Determination of Switch Units 1»

In position determination of the switch units 1 by the position determination part 14, for example, an address setting for I2C communication of a sensor IC provided in each of the switch units 1 can be utilized. The sensors IC are each an IC for driving an electrostatic sensor, for example. The other two switch units 1 not including a control IC (1Sa) are connected to the switch unit 1 including the control IC (1Sa), so that a predetermined address is automatically set to the sensor IC of each of the other two switch units 1.

Figure 3:
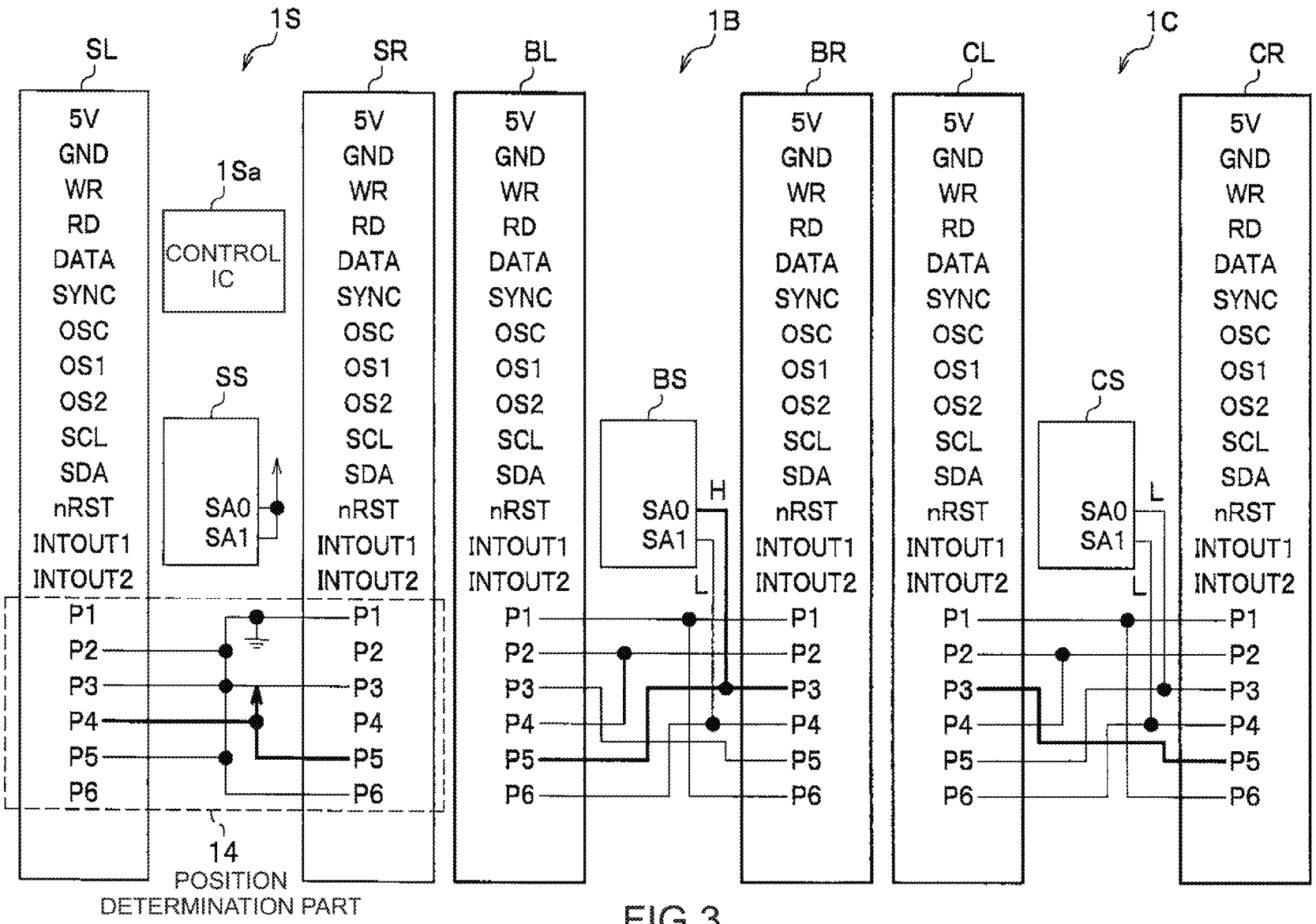
FIG. 3 is a connection terminal diagram (1) for illustrating determination of a position of each of the switch units disposed in a single row.

[1] For example, in some cases, the two switch units 1B, 1C not including a control IC (1Sa) are connected on the right side of the switch unit 1S including the control IC (1Sa). In this case, as illustrated in FIG. 3, a connector SR of the switch unit 1S and a connector BL of the switch unit 1B are connected, and a connector BR of the switch unit 1B and a connector CL of the switch unit 1C are connected. As a result, respective terminals of "5V", "GND", "WR", "RD", "DATA", "SYNC", "OSC", "OS1", "OS2", "SCL", "SDA", "nRST", "INTOUT1", "INTOUT2", and "P1" to "P6" of the connectors are connected, and predetermined information can be exchanged. The terminals of "5V", "GND", "WR", "RD", "DATA", "SYNC", "OSC", "OS1", "OS2", "nRST", "INTOUT1", and "INTOUT2" are known, and their description is omitted. The "SCL" is a terminal for exchanging a clock signal via the same communication line. The "SDA" is a terminal for exchanging a data signal via the same communication line.

The terminals of "P1" to "P6" are prepared for the position determination of the switch units 1. As illustrated in FIG. 3, a connection form of the terminals of "P1" to "P6" between the connectors SL and SR of the switch unit 15 including the control IC (1Sa) forms the position determination part 14. As illustrated in FIG. 3, a connection form of the terminals of "P1" to "P6" between the connectors BL and BR of the switch unit 1B not including a control IC (1Sa), and a connection form of the terminals of "P1" to "P6" between the connectors CL and CR of the switch unit 1C not including a control IC (1Sa) are the same.

As illustrated in FIG. 3, some wires between the terminals "P1" to "P6" of the connectors SL and SR of the switch unit 1S are grounded while some wires are pulled up. Therefore, "H (High)" (one of the two kinds of first voltage values) is input to an SA0 address of the sensor IC (BS) of the switch unit 1B, and "L (Low)" (the other of the two kinds of first voltage values) is input to an SA1 address. Input addresses (SA0, SA1)=(H, L) (voltage value group) indicate that the switch unit 1B is disposed adjacently on the right side of the switch unit 1S to be connected to the switch unit 1S.

Additionally, "L" is input to an SA0 address of the sensor IC (CS) of the switch unit 1C, and "L" is also input to the SA1 address. Input addresses (SA0, SA1)=(L, L) (voltage value group) indicate that the switch unit 1C is connected to the switch unit 1S through one switch unit 1 (herein, 1B). The switch units 1 disposed in a single row are three, and therefore addresses (SA0, SA1)=(L, L) indicate that the switch unit 1C is disposed on the right side of the switch unit 1S.

A sensor IC (SS) of the switch unit 1S does not contribute to the position determination of the switch units 1.

Figure 4:
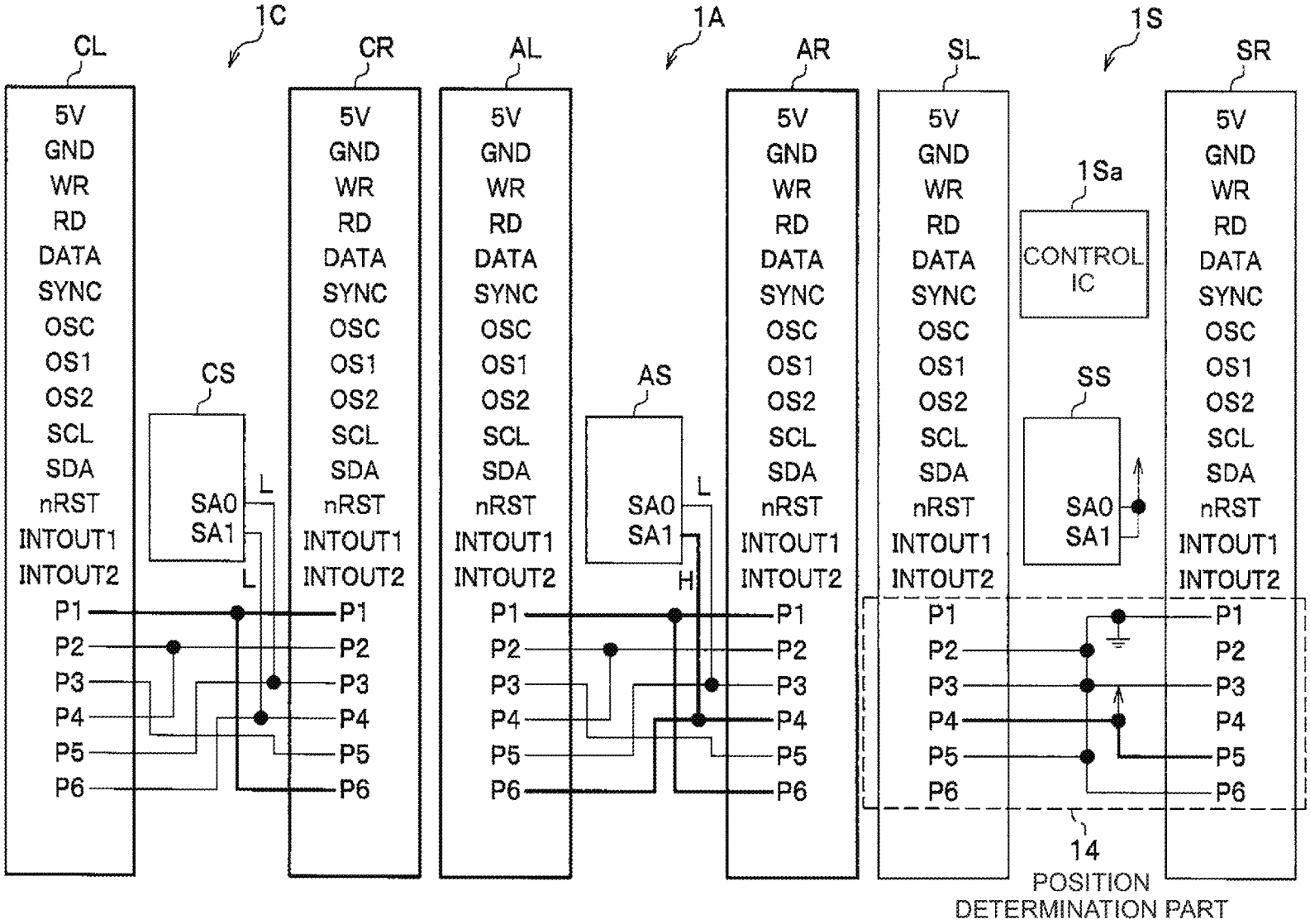
FIG. 4 is a connection terminal diagram (2) for illustrating determination of a position of each of the switch units disposed in a single row.

[2] For example, in some cases, the two switch units 1A, 1C not including a control IC (1Sa) are connected on the left side of the switch unit 15 including the control IC (1Sa). In this case, as illustrated in FIG. 4, a connector SL of the switch unit 15 and a connector AR of the switch unit 1A are connected, and a connector AL of the switch unit 1A and a connector CR of the switch unit 1C are connected. In FIG. 4, similarly to FIG. 3, a connection form of terminals of "P1" to "P6" between the connectors AL and AR of the switch unit 1A, and a connection form of terminals of "P1" to "P6" between the connectors CL and CR of the switch unit 1C are the same.

As a result, "L" is input to the SA0 address of the sensors IC (AS) of the switch units 1A, and "H" is input to the SA1 address. Input addresses (SA0, SA1)=(L, H) (voltage value group) indicate that the switch units 1A disposed adjacently on the left side of the switch unit 1S is connected to the switch unit 1S.

Additionally, "L" is input to the SA0 address of the sensor IC (CS) of the switch unit 1C, and "L" is also input to the SA1 address. Input addresses (SA0, SA1)=(L, L) (voltage value group) indicate that the switch unit 1C is connected to the switch unit 1S through the one switch unit 1 (herein, 1A). There are three switch units 1 disposed in a single row, and therefore addresses (SA0, SA1)=(L, L) indicate that the switch unit 1C is disposed on the left side of the switch unit 1S.

Figure 5:
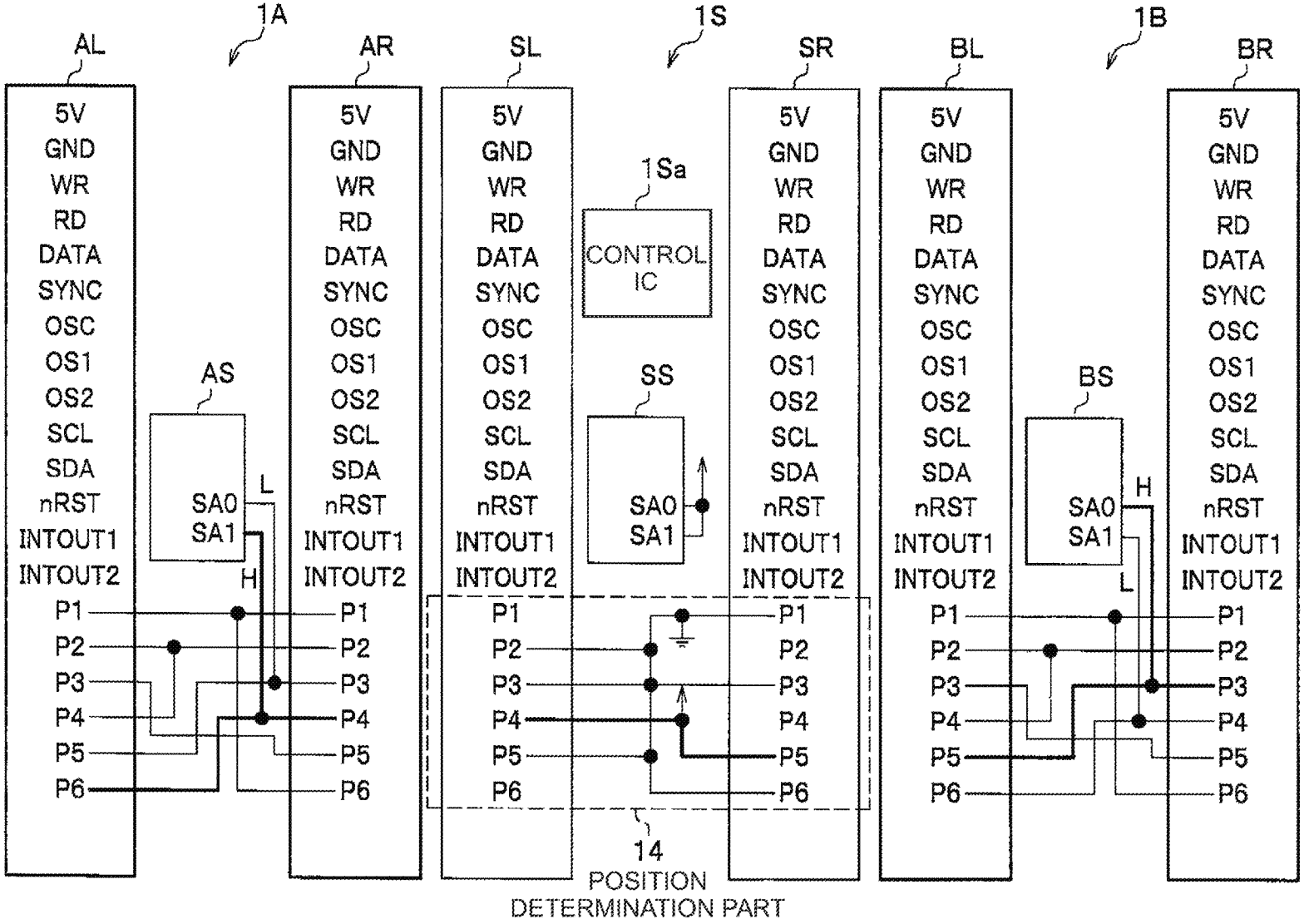
FIG. 5 is a connection terminal diagram (3) for illustrating determination of a position of each of the switch units disposed in a single row.

[3] For example, in some cases, the one switch unit 1B is connected on the right side of the switch unit 1S, and the one switch unit 1A is connected on the left side of the switch unit 1S. In this case, as illustrated in FIG. 5, the connector SR of the switch unit 1S and the connector BL of the switch unit 1B are connected, and the connector SL of the switch unit 1S and the connector AR of the switch units 1A are connected.

As a result, similarly to the case of FIG. 3, addresses (SA0, SA1)=(H, L) (voltage value group) are set for the sensor IC (BS) of the switch unit 1B disposed adjacently on the right side of the switch unit 15. Additionally, similarly to the case of FIG. 4, addresses (SA0, SA1)=(L, H) (voltage value group) are set for the sensor IC (AS) of the switch unit 1A disposed adjacently on the left side of the switch unit 15.

In any case of the above [1] to [3], the switch unit 1S acquires the addresses set for the sensors IC (AS, BS, CS) from the switch units 1A to 1C via the same communication line. The position determination part 14 determines respective positions of the switch units 1A to 1C by using the acquired addresses.

<<Determination of Numbers of Keys of Switch Units 1>>

The determination of the number of keys of each of the switch units 1 by the key number determination part 15 is performed when the switch units 1 are connected, similarly to the position determination of the switch units 1.

Figure 6:
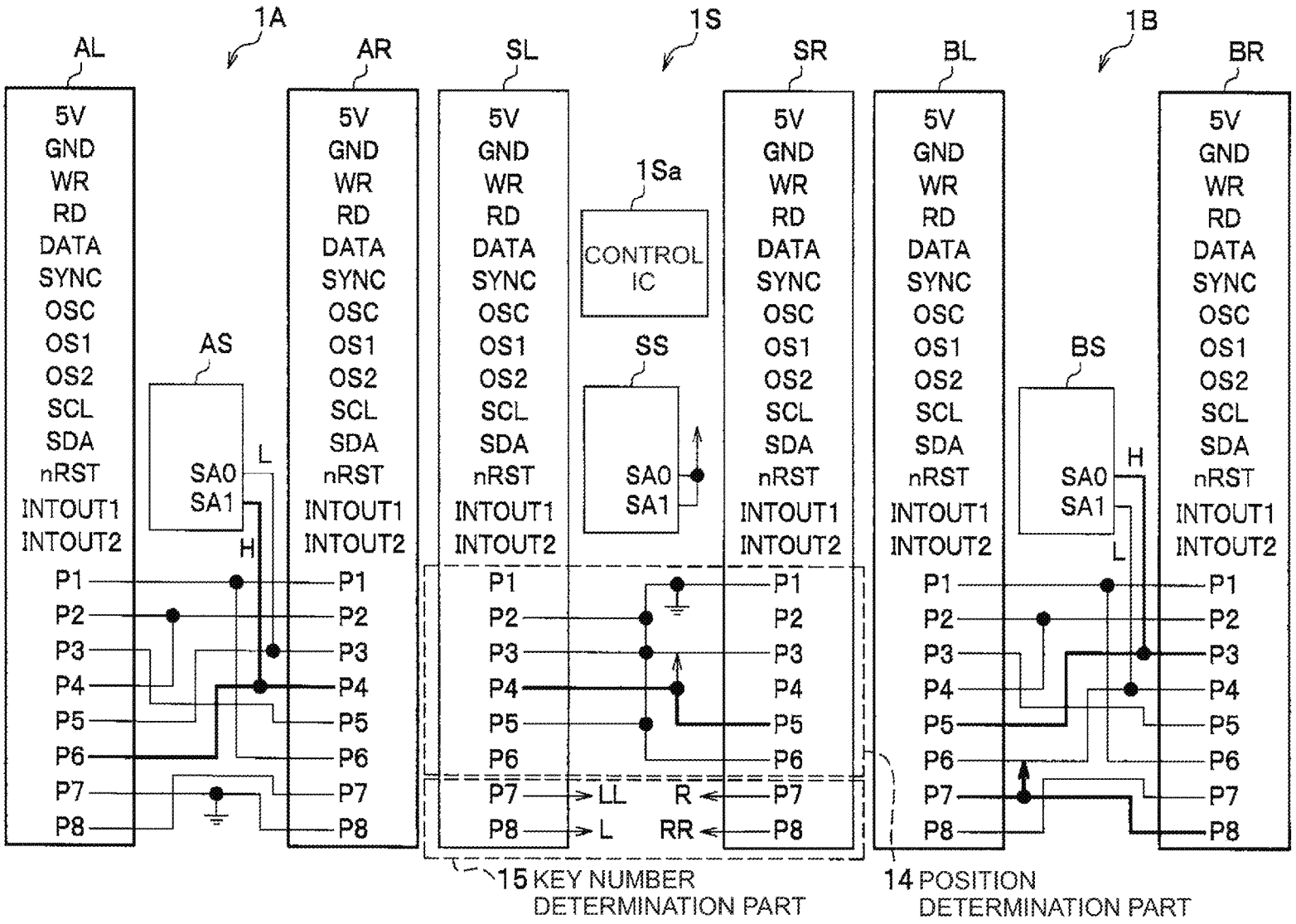
FIG. 6 is a connection terminal diagram for illustrating determination of the number of keys of each of the switch units disposed in a single row.

As illustrated in FIG. 6, for example, a case where the one switch unit 1B is connected on the right side of the switch unit 1S, and the one switch unit 1A is connected on the left side of the switch unit 1S is assumed. Respective terminals of "P7", "P8" provided in the connectors SL, SR, AL, AR, BL, BR of the switch units 1S, 1A, 1B are prepared for the determination of the number of keys of each of the switch units 1. The terminals "P7", "P8" of the connectors SL, SR of the switch unit 1S form the key number determination part 15.

For example, a circuit can be designed such that "H" (second voltage value) is input from the switch unit 1 of 6 keys to the switch unit 1S, and "L" (second voltage value) is output from the switch unit 1 of 4 keys to the switch unit 1S.

<1> Output data R is output from the terminal "P7" of the connector SR of the switch unit 15. The output data R is data for identifying the number of keys of the switch unit 1B disposed adjacently on the right side of the switch unit 15. In the case of FIG. 6, the number of keys of the switch unit 1B is 6, and therefore a wire connected to the terminal "P7" of the connector BL is pulled up. Therefore, a value of the output data R becomes "H", and the key number determination part 15 can determine that the number of keys of the switch unit 1B connected adjacently on the right side of the switch unit 1S is 6.

<2> Output data RR is output from the terminal "P8" of the connector SR of the switch unit 15. The output data RR is data for identifying the number of keys of the switch unit (equivalent to 1C of FIG. 3) disposed further adjacently on the right side of the switch unit 1B disposed adjacently on the right side of the switch unit 15. In the case of FIG. 6, the position determination part 14 determines that no switch unit 1 exists further adjacently on the right side of the switch unit 1B disposed adjacently on the right side of the switch unit 1S, and therefore the output data RR is ignored.

<3> Output data LL is output from the terminal "P7" of the connector SL of the switch unit 1S. The output data LL is data for identifying the number of keys of the switch unit (equivalent to 1C of FIG. 4) disposed further adjacently on the left side of the switch unit 1A disposed adjacently on the left side of the switch unit 15. In the case of FIG. 6, it is determined by the position determination part 14 that no switch unit 1 exists further adjacently on the left side of the switch unit 1B disposed adjacently on the left side of the switch unit 1S, and therefore the output data LL is ignored.

<4> Output data L is output from the terminal "P8" of the connector SL of the switch unit 15. The output data L is data for identifying the number of keys of the switch unit 1A disposed adjacently on the left side of the switch unit 15. In the case of FIG. 6, the number of keys of the switch unit 1A is 4, and therefore a wire connected to the terminal "P8" of the connector AR is grounded. Therefore, a value of the output data L becomes "L", and the key number determination part 15 can determine that the number of keys of the switch unit 1A connected adjacently on the left side of the switch unit 1S is 4.

The key number determination part 15 has information (for example, when the number of keys is 6, the value of output data is "H", and when the number of keys is 4, the value of output data is "L") for identifying the number of keys of the switch unit 1S.

According to the above <1> to <4>, in whatever parallel arrangement the three switch units 1 are disposed in a single row, the determination of the number of keys of each of the switch units 1 by the key number determination part 15 is performed.

<<Processes>>

Figure 7:
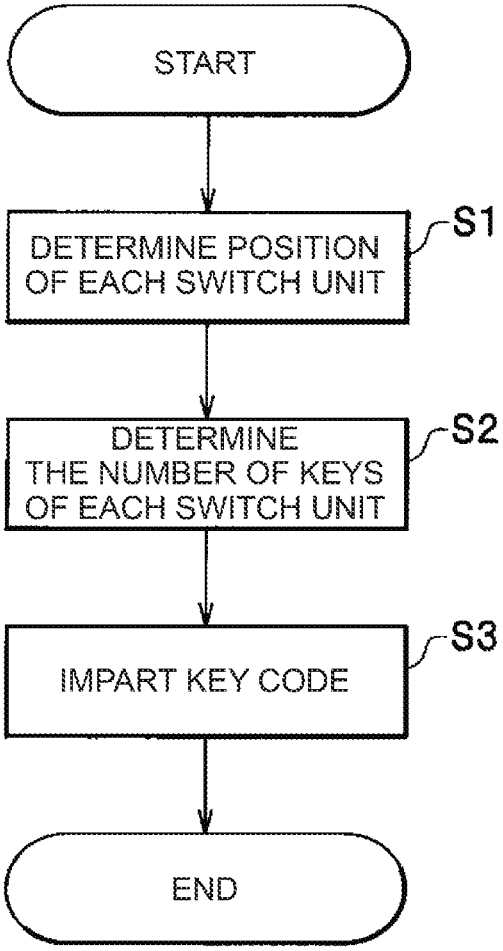
FIG. 7 is a flowchart of processes related to allocation in the switch units.

In a case where the switch unit 1S and the other two switch units 1 disposed in a single row are communicatively connected, the control IC (1Sa) of the switch unit 1S performs processes illustrated in FIG. 7. The processes of FIG. 7 start from Step S1.

In Step S1, the control IC (1Sa) causes the position determination part 14 to determine respective positions of the switch units 1. A method for determining the respective positions of the switch units 1 is described in the above described with reference to FIG. 3 to FIG. 5. The correspondence relationship between the values of the addresses (SA0, SA1), and switch unit positions becomes as illustrated in FIG. 8. In FIG. 8, "self" indicates the switch unit 1S including the control IC (1Sa).

Thereafter, in Step S2, the control IC (1Sa) causes the key number determination part 15 to determine the number of keys of each of the switch units 1 at each position. A method for determining the respective numbers of keys of the switch units 1 is explained as above with reference to FIG. 6. The correspondence relationship between the respective values output from the three switch units 1 disposed on the left, the center and the right ("H" (6 keys) or "L" (4 keys), second voltage values) and the total number of keys by the switch units 1 disposed in a single row becomes as illustrated in FIG. 9. In FIG. 9, in a case where the number of the switch units 1 disposed in a single row is two, the two switch units 1 are disposed on the "left" or the "right" ("center" is excluded). As illustrated in FIG. 9, the number of keys of each of the switch units 1 disposed in a single row is 4 or 6, and therefore the total number of keys in a single row becomes any of 8, 10, 12, 14, 16 and 18. Additionally, "0" in FIG. 9 indicates the total number of keys to each of combinations of "H" or "L" of the three switch units 1.

Thereafter, in Step S3, the control IC (1Sa) causes the code impartment part 16 to impart the key codes to the respective keys of the switch units 1 disposed in a single row in the order from the left (refer to FIGS. 2A, 2B and 2C).

According to the processes of FIG. 7, the illumination parts 11, the price display parts 12 and the commodity selection parts 13 provided in the switch units 1 disposed in an arbitrary order can be automatically allocated to the vending machine system 2 via the communication line.

<<Commonization of Communication Format of Control Command>>

In the present embodiment, the illumination parts 11, the price display parts 12 and the commodity selection parts 13 provided in the switch units 1 are formed integrally, and therefore the three switch units 1 disposed in a single row can be connected to any of the three ports 2*a*, 2*b* and 2*c* of the vending machine system 2 via the same communication line. Accordingly, it is possible to reduce the number of wires required for the connection of the switch units 1 and the vending machine system 2. Conventionally, respective parts equivalent to the illumination parts 11, the price display parts 12 and the commodity selection parts 13 are independently formed, and therefore respective wires for connecting the vending machine system 2 to the illumination parts 11, the price display parts 12, and the commodity selection parts 13 need to be prepared, and a great quantity of time and labor are required to allocate purchase buttons to the vending machine body.

In the present embodiment, the three switch units 1 disposed in a single row are connected to the vending machine system 2 via the same communication line, and therefore it is possible to commonize a communication format of a control command (information) transmitted and received between each of the three switch units 1 disposed in a single row and the vending machine system 2 via the communication line. An example of the commonized communication format is illustrated in FIG. 10. The commodity selection parts 13 of the switch units 1 can be controlled to follow a value in a corresponding "Data" column (indication in FIG. 10 is omitted) by "Select" in a "Command" column of the communication format illustrated in FIG. 10. The price display parts 12 of the switch units 1 can be controlled to follow a value in a corresponding "Data" column (indication in FIG. 10 is omitted) by "Price" in the "Command" column of the communication format illustrated in FIG. 10. The illumination parts 11 of the switch units 1 can be controlled to follow a value in a corresponding "Data" column (indication in FIG. 10 is omitted) by "Illumination" in the "Command" column of the communication format illustrated in FIG. 10.

The control command commonized by the communication format can be directed to the three switch units 1 disposed in a single row.

SUMMARY

According to the present embodiment, in whatever order the three switch units 1 are disposed in a single row, the position determination parts 14 can determine the relative positions of the three switch units, and the code impartment part 16 can impart the key codes in the order from one end (from the left) to the other of the samples of the commodities (the order from the right may be possible). Accordingly, it is possible to automate allocation work of the purchase buttons (commodity selection part 13) conventionally performed by a worker.

Therefore, it is possible to remarkably reduce the amount of work required to assemble the vending machine.

No matter how many keys of the switch units 1 are attached to the vending machine V, the total number of the keys of the three switch units 1 disposed in a single row can be obtained by the key number determination part 15. Therefore, it is possible to reliably impart the key code to each of the samples of the commodities in a single row.

The three switch units 1 disposed in a single row are connected to the vending machine system 2 via the same communication line, so that it is possible to reduce the number of the wires required for the connection of the switch units 1 and the vending machine system 2, and it is possible to further reduce the amount of work required to assemble the vending machine V.

The communication format of the information transmitted and received between each of the three switch units 1 disposed in a single row and the vending machine system 2 via the communication line is commonized, so that it is possible to simplify information exchange between each of the illumination parts 11, the price display part 12 and the commodity selection part 13 forming the switch units 1 and the vending machine system 2.

(Variant)

(1): Although the example in which the switch units are applied to the vending machine in the present embodiment is described, the present disclosure is not limited to the vending machine, and for example, the switch unit can be applied to a coin-operated locker, a game machine, or the like.

(2): Although the example in which the three switch units are disposed in a single row in the present embodiment is described, the present disclosure can be applied, for example, to a case where four or more switch units are disposed in a single row by design change such as an increase in the kinds of addresses (in addition to SA0, SA1), and an increase in the number of bits of a single address (formation of a value other than "H" and "L"). For example, the present disclosure can be applied to a case where two switch units are disposed in a single row by use of a system of the present embodiment. Although the case where the switch units 1 are disposed in three rows is described in the present embodiment, the present disclosure can be applied to a case where the switch units 1 are disposed in two rows or fewer or in four rows or more.

(3): In the present embodiment, the case where the other two switch units 1 not including a control IC (1Sa) are connected to the one switch unit 1S including the control IC (1Sa) is described. However, the present disclosure can be applied for example, even in a case where one or both of the other two switch units 1 include a control IC(s) equivalent to the control IC (1Sa). In this case, the control IC provided in one or both of the other two switch units 1 only need only not operate or not function. Consequently, it is possible to further commonize hardware of the three switch units 1 disposed in a single row, and a worker can attach the switch units 1 to the vending machine without paying attention to the presence or absence of the control IC, and therefore it is possible to further reduce the amount of work required to assemble the vending machine. The above content is also applied to a case where the number of the switch units 1 in a single row is two, or four or more.

It is possible to implement a technology obtained by suitably combining the various technologies described in the present embodiment.

In addition, the shapes, arrangements and the like of the components of the present disclosure can be suitably changed without departing from the spirit of the present disclosure.

What is claimed is:

1. A controller switch unit comprising:

a commodity selection part;

an illumination part;

a price display part; and a control part, wherein the controller switch unit is communicatively connected to at least one slave switch unit, and the control part includes:

a position determination part configured to determine a relative position of said at least one slave switch unit to the controller switch unit; and a code impartment part configured to impart a code to a plurality of keys of each of the controller switch unit and said at least one slave switch unit on the basis of the determined relative position.

2. The controller switch unit according to claim 1, wherein the position determination part outputs two kinds of first voltage values to said at least one slave switch unit connected to the controller switch unit, and sets a voltage value group based on the relative position of said at least one slave switch unit.

3. The controller switch unit according to claim 1, wherein the control part further includes a key number determination part configured to determine the number of keys of each of controller switch unit and said at least one slave switch unit.

4. The controller switch unit according to claim 3, wherein the key number determination part stores a number of keys of the controller switch unit, and acquires a second voltage value, for identifying a number of keys of said at least one slave switch unit, from said at least one slave switch unit.

5. The controller switch unit according to claim 4, wherein the code impartment part configures codes to the keys of the controller switch unit and the keys of the said at least one slave switch unit on the basis of the determined relative position, the number of keys of the controller switch unit stored by the key number determination part, and the number of keys of the slave switch unit identified by the second voltage value acquired from said at least one slave switch unit.

6. The controller switch unit according claim 1, wherein the controller switch unit and said at least one slave switch unit are connected to an external system via a common communication line.

7. The controller switch unit according to claim 6, wherein a communication format of information transmitted to and received from the controller switch unit and said at least one slave switch unit, and the external system via the common communication line, is standardized.

8. A vending machine comprising the controller switch unit according to claim 1.

* * * * *